US011496839B2

(12) United States Patent
Ko et al.

(10) Patent No.: US 11,496,839 B2
(45) Date of Patent: Nov. 8, 2022

(54) SPEAKER UNIT FOR EARPHONE

(71) Applicant: ALMUS Corp., Chungcheongnam-do (KR)

(72) Inventors: Ju Heon Ko, Gyeonggi-do (KR); Byung Il Min, Gyeonggi-do (KR); Jeong Kwon Park, Gyeonggi-do (KR); Yun Uk Ha, Incheon (KR); JongWon Lee, Incheon (KR); Seo Young Kim, Gyeonggi-do (KR); Soon Hyuk Hong, Gyeonggi-do (KR)

(73) Assignee: ALMUS Corp., Chungcheongnam-do (KR)

( * ) Notice: Subject to any disclaimer, the term of this patent is extended or adjusted under 35 U.S.C. 154(b) by 0 days.

(21) Appl. No.: 17/386,249

(22) Filed: Jul. 27, 2021

(65) Prior Publication Data

US 2022/0312124 A1 Sep. 29, 2022

(30) Foreign Application Priority Data

Mar. 26, 2021 (KR) ..... 10-2021-0039901

(51) Int. Cl.
*H04R 9/06* (2006.01)
*H04R 9/04* (2006.01)
(Continued)

(52) U.S. Cl.
CPC ..... *H04R 9/045* (2013.01); *H04R 1/023* (2013.01); *H04R 1/1016* (2013.01); *H04R 9/06* (2013.01);
(Continued)

(58) Field of Classification Search
CPC .... H04R 1/023; H04R 1/1008; H04R 1/1016; H04R 1/1083; H04R 1/24; H04R 9/045;
(Continued)

(56) References Cited

U.S. PATENT DOCUMENTS

2002/0168074 A1* 11/2002 Miyamoto ..... H04R 9/10 381/182
2015/0296287 A1* 10/2015 Huang ..... H04R 1/1083 381/71.6
(Continued)

FOREIGN PATENT DOCUMENTS

KR 10-1501898 B1 3/2015
KR 10-2017-0098527 A 8/2017
(Continued)

OTHER PUBLICATIONS

Office Action from corresponding Korean Patent Application No. 10-2021-0039901, dated May 25, 2022.

*Primary Examiner* — Huyen D Le
(74) *Attorney, Agent, or Firm* — Harness, Dickey & Pierce, P.L.C.

(57) ABSTRACT

A speaker unit is provided. The speaker unit may include a frame; a yoke elongated on the frame along a front-to-rear direction; a first magnet disposed on one side of the yoke; a first plate disposed on one side of the first magnet; a first diaphragm disposed on one side of the first plate; a first coil fixed to the first diaphragm; a second magnet disposed on the other side of the yoke; a second plate disposed on the other side of the second magnet; a second diaphragm disposed on the other side of the second plate; a substrate disposed on the frame; a microphone electrically connected to the substrate; and a second coil fixed to the second diaphragm, wherein the first magnet and the second magnet are both in contact with the yoke, the frame includes a seating portion, and the microphone is disposed in the seating portion.

15 Claims, 14 Drawing Sheets

(51) Int. Cl.
*H04R 1/10* (2006.01)
*H04R 1/02* (2006.01)

(52) U.S. Cl.
CPC ..... *H04R 9/063* (2013.01); *H04R 2201/107* (2013.01); *H04R 2209/026* (2013.01); *H04R 2499/11* (2013.01)

(58) Field of Classification Search
CPC .... H04R 9/06; H04R 9/063; H04R 2201/107; H04R 2209/026; H04R 2499/11
See application file for complete search history.

(56) References Cited

U.S. PATENT DOCUMENTS

| | | | | |
|---|---|---|---|---|
| 2021/0044893 | A1* | 2/2021 | Park | H04R 1/345 |
| 2022/0095056 | A1* | 3/2022 | Ji | H04R 1/1016 |

FOREIGN PATENT DOCUMENTS

| | | | |
|---|---|---|---|
| KR | 10-1952068 | B1 | 2/2019 |
| KR | 10-2097472 | B1 | 4/2020 |

* cited by examiner

SPEAKER UNIT FOR EARPHONE

CROSS-REFERENCE TO RELATED APPLICATION

This application claims the benefit under 35 USC § 119(a) of Korean Patent Application No. 10-2021-0039901, filed on Mar. 26, 2021, in the Korean Intellectual Property Office, the entire disclosure of which is incorporated herein by reference for all purposes.

FIELD

The following description relates to a speaker unit for an earphone.

BACKGROUND

The earphone includes, inside a housing, a speaker unit that generates sound waves. Also, the earphone may include the housing that includes a nozzle to which an ear tip is coupled.

An example of an earphone including a nozzle is disclosed in Korean Laid-Open Patent Publication No. 10-2017-0098527 (published on Aug. 30, 2017, hereinafter referred to as the present document). In the present document, a speaker unit is included in a housing that includes a nozzle.

The speaker unit may include a microphone. The microphone receives a signal that enters through the nozzle. A separate bracket is required to mount the microphone. The bracket is coupled to a frame of the speaker unit and then the microphone is mounted on the bracket.

Thus, the speaker unit needs to be designed in consideration of the mounting space of the bracket. That is, there is a spatial limitation in designing the speaker unit.

PRIOR ART DOCUMENT

[Patent Document]

(Patent Document 0001) Korean Laid-Open Patent Publication No. 10-2017-0098527 (published on Aug. 30, 2017)

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

An objective of the present invention is to provide a speaker unit for an earphone which can secure sufficient design space by removing a spatial limitation.

The objective to be achieved by the present invention is not limited to the foregoing objective, and additional objectives, which are not mentioned herein, will be readily understood by those skilled in the art from the following description.

In one general aspect, there is provided a speaker unit including a frame, a yoke elongated on the frame along a front-to-rear direction, a first magnet disposed on one side of the yoke, a first plate disposed on one side of the first magnet, a first diaphragm disposed on one side of the first plate, a first coil fixed to the first diaphragm, a second magnet disposed on the other side of the yoke, a second plate disposed on the other side of the second magnet, a second diaphragm disposed on the other side of the second plate, a substrate disposed on the frame, a microphone electrically connected to the substrate, and a second coil fixed to the second diaphragm, wherein the first magnet and the second magnet are both in contact with the yoke, the frame includes a seating portion, and the microphone is disposed in the seating portion.

The frame may have one surface on which a sound emission hole is disposed, the other surface opposite to the one surface, and a lateral surface connecting the one surface to the other surface, and the seating portion may be disposed on the lateral surface.

The frame may include a seating surface in contact with the microphone and a guide disposed along a periphery of the seating surface to form a slot in which the microphone is accommodated.

The frame may include a plurality of protruding portions protruding from the guide and disposed to overlap a portion of the microphone.

The microphone may include a base and a microphone module disposed on the base, the base may include a groove, and a part of the guide may be disposed in the groove.

The frame may include a hole disposed on the seating surface and a first passage connected from the other surface of the frame to the hole, and the hole may communicate with the first passage.

The frame may include a second passage passing through one side and the other side of the frame.

The frame may include a rib protruding from the seating surface and disposed along a circumference of the hole, and the base may include a first surface in contact with the seating surface, and a first groove recessed on the first surface and allowing the rib to be positioned therein.

The guide may include a first area protruding from one surface of the frame, and some of the plurality of protruding portions may be disposed in the first area.

A direction in which sound is transmitted to the microphone through the first passage and a direction in which sound is emitted from the first diaphragm and the second diaphragm may be opposite to each other.

In another general aspect, there is provided a speaker unit including a frame, a magnet, a plate fixed to the frame and in contact with the magnet, a diaphragm, a coil disposed to overlap the magnet and the plate in a radial direction, a flexible printed circuit board (FPCB), a microphone connected to the FPCB, and a grill disposed on the frame, wherein the grill includes a seating portion and the microphone is disposed in the seating portion.

The grill may include an annular-shaped body fixed to the frame, and the seating portion may include a first part extending from an inner circumferential surface of the body and a second part extending from the first part to which the microphone is mounted.

The first part may include a first-1 part and a first-2 part, the first-1 part may extend inward from the inner circumferential surface of the body, and the first-2 part may extend forward from the first-1 part and be connected to the second part.

The seating portion may include a guide extending from each side of the second part and disposed to be stepped from the second part so as to be in contact with each side of the microphone.

The seating portion may be disposed to overlap the diaphragm in a front-to-rear direction.

The microphone may be disposed to overlap the diaphragm in the front-to-rear direction.

Other features and aspects will be apparent from the following detailed description, the drawings, and the claims.

Figure 1:
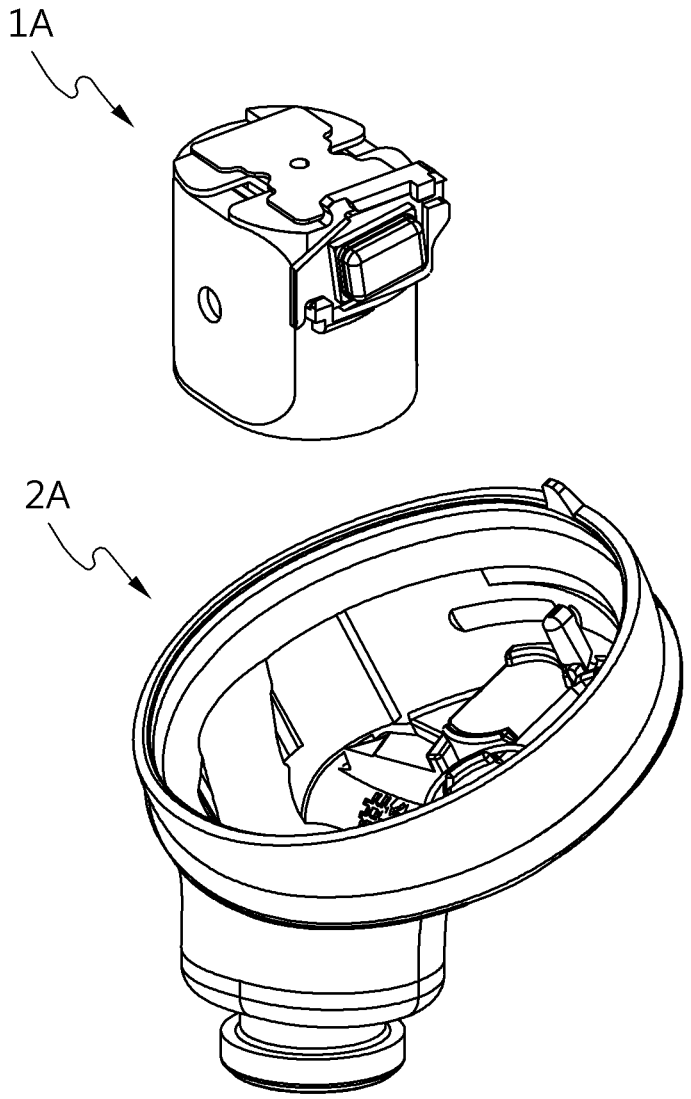
FIG. 1 is a diagram illustrating an earphone including a speaker unit according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

The objects, features and advantages of the present invention will be more clearly understood from the following detailed description and preferred embodiments taken in conjunction with the accompanying drawings. It should be understood that terms or words used in the specification and the appended claims should not be construed as being limited to commonly employed meanings or dictionary definitions, but interpreted based on meanings and concepts corresponding to the technical idea of the invention, on the basis of the principle that inventors are allowed to define terms appropriately for the best explanation of their invention. Further, in the description of the present invention, detailed descriptions of related well-known functions that are determined to unnecessarily obscure the gist of the present invention will be omitted.

Hereinafter, a speaker unit for an earphone according to an embodiment will be described in detail with reference to the accompanying drawings.

Figure 2:
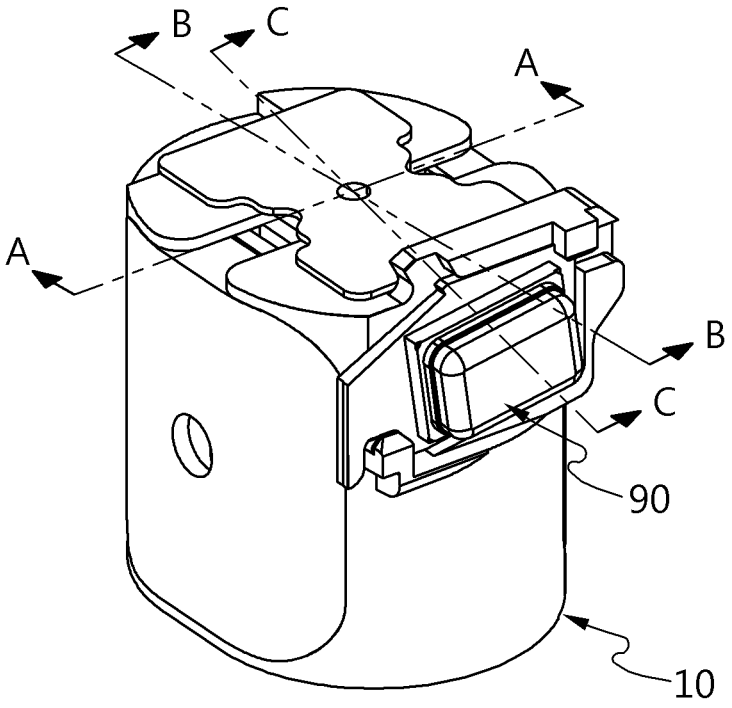
FIG. 2 is a perspective view of the speaker unit shown in FIG. 1.
Figure 3:
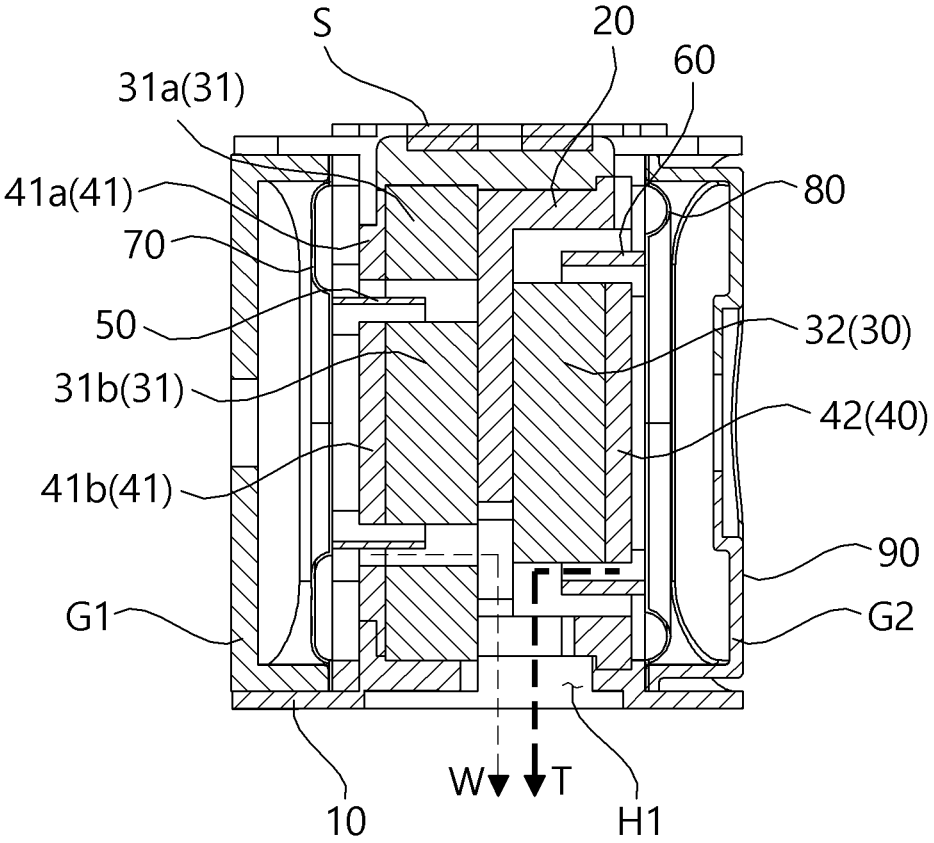
FIG. 3 is a side cross-sectional view of the speaker unit taken along line A-A of FIG. 2.
Figure 4:
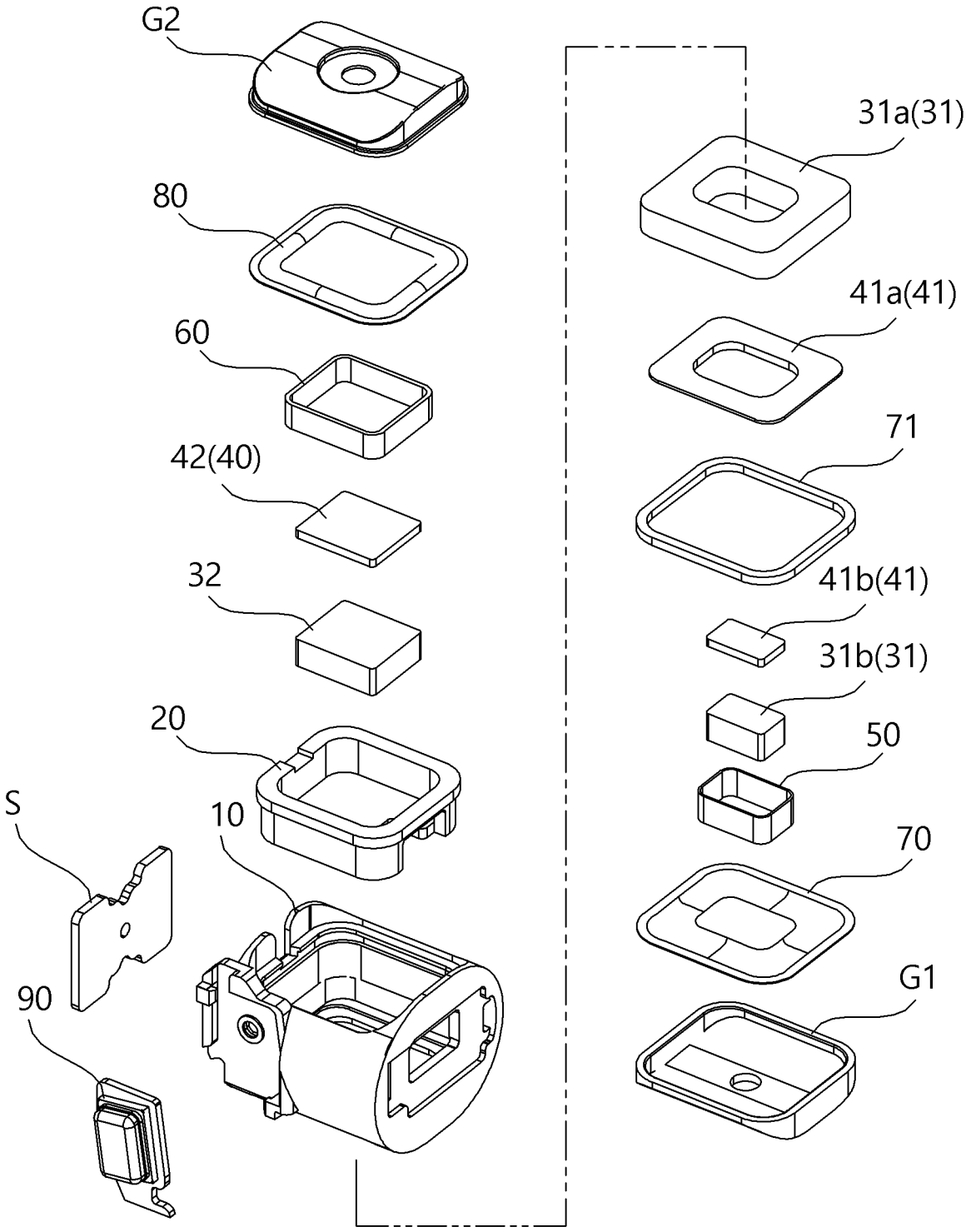
FIG. 4 is an exploded view of the speaker unit shown in FIG. 2.

FIG. 1 is a diagram illustrating an earphone including a speaker unit according to an embodiment, FIG. 2 is a perspective view of the speaker unit shown in FIG. 1, FIG. 3 is a side cross-sectional view of the speaker unit, taken along line A-A of FIG. 1, and FIG. 4 is an exploded view of the speaker unit shown in FIG. 2.

The terms "front" or "forward" refer to a direction in which sound is emitted through a first diaphragm 70 and a second diaphragm 80, and the terms "rear" or "rearward" refer to the direction opposite to the front or forward direction.

A speaker unit 1A according to an embodiment includes both configurations (two-way type) for reproducing sound in a low frequency range and sound in a high frequency range. In addition, the speaker unit 1A according to the embodiment includes a configuration for reproducing sound in a low frequency range and a configuration for reproduction sound in a high frequency range.

The speaker unit 1A according to the embodiment may be disposed in the internal space of the housing 2A.

The speaker unit according to the embodiment may include a frame 10, a yoke 20, a magnet 30, a plate 40, a first coil 50, a second coil 60, a first diaphragm 70, a second diaphragm 80, and a microphone 90. The first magnet 30 may include a first magnet 31 and a second magnet 32. The plate 40 may include a first plate 41 and a second plate 42.

The first magnet 31 and the second magnet 32 share the yoke 20. Accordingly, the speaker unit 1A may be aligned, not in the front-to-rear direction, but in the direction perpendicular to the front-to-rear direction, and thus be disposed in a standing manner. The speaker unit is disposed in a standing manner, and thus the size of the earphone can be reduced and a sufficient inner space can be secured. In addition, tuning structures may be implemented without an additional configuration.

A specific configuration of the speaker unit 1A according to the embodiment is described below.

The frame 10 has an accommodating space inside. The frame 10 includes a hole H1 through which sound is emitted.

The yoke 20 is disposed inside the frame 10. The first magnet 31 and the second magnet 30 are in contact with the yoke 20.

The first magnet 310 may include a first A magnet 31*a* and a first B magnet 31*b*. The first A magnet 31*a* may be disposed outside the first coil 50 and electromagnetically interact with the first coil 50. The first B magnet 31*b* may be disposed inside the first coil 50 and electromagnetically interact with the first coil 50. The first A magnet 31*a* may have a rectangular ring shape. The first B magnet 31*b* may have a hexahedral shape.

The second magnet 32 may electromagnetically interact with the second coil 60. The second magnet 32 may have a hexahedral shape.

The first plate 41 is brought into contact with the first magnet 31 so that a magnetic field is created. The first plate 41 may include a first A plate 41*a* and a first B plate 41*b*. The first A plate 41*a* may be in contact with one surface of the first A magnet 31*a*. The first A plate 41*a* may have a rectangular ring shape. The first B plate 41*b* may be in contact with one surface of the first B magnet 31*b*. The first B plate 41B may have a rectangular shape.

The second plate 42 is brought into contact with the second magnet 32 so that a magnetic field is created. The second plate 4 may have a rectangular shape.

The first coil 50 may be disposed between the first A magnet 31*a* and the first B magnet 31*b* in the front-to-rear direction. Also, the first coil 50 may be disposed between the first A plate 41*a* and the first B plate 41*b* in the front-to-rear direction. The first coil 50 may be disposed such that a portion thereof overlaps the first magnet 31 and the first plate 41 in the front-to-rear direction.

The second coil 60 may be disposed such that a portion thereof overlaps the second magnet 32 and the second plate 42 in the front-to-rear direction.

The first diaphragm 610 may be disposed outside the first plate 41 and fixed to the frame 10. The first coil 50 is fixed to the first diaphragm 70. A vibration direction of the first diaphragm 70 may be perpendicular to the front-to-rear direction.

The second diaphragm 80 may be disposed outside the second plate 42 and fixed to the frame 10 via a fixing ring 71. The second coil 80 is fixed to the second diaphragm 60. A vibration direction of the second diaphragm 80 may be perpendicular to the front-to-rear direction.

A first grill G1 is disposed outside the first diaphragm 70. The first grill G1 may be fixed to the frame 10.

The second grill G2 is disposed outside the second diaphragm 80. The second grill G2 may be fixed to the frame 10.

A substrate S may be disposed on the other surface of the frame 10.

Low-frequency sound reproduced by the first diaphragm 70 is emitted through the hole H1 of the frame 10. High-frequency sound reproduced by the second diaphragm 80 is also emitted through the hole H1 of the frame 10.

The microphone 90 may be directly coupled to the frame 10 without an additional bracket. The frame 10 is provided with a structure for mounting the microphone 90.

Figure 5:
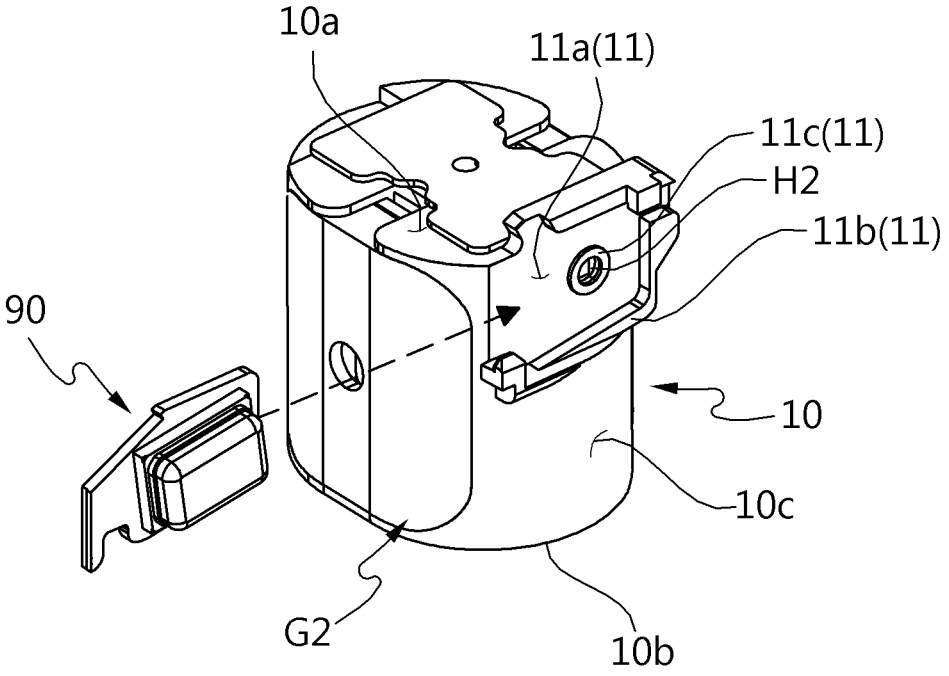
FIG. 5 is a diagram illustrating a frame and a microphone of the speaker unit shown in FIG. 4.
Figure 6:
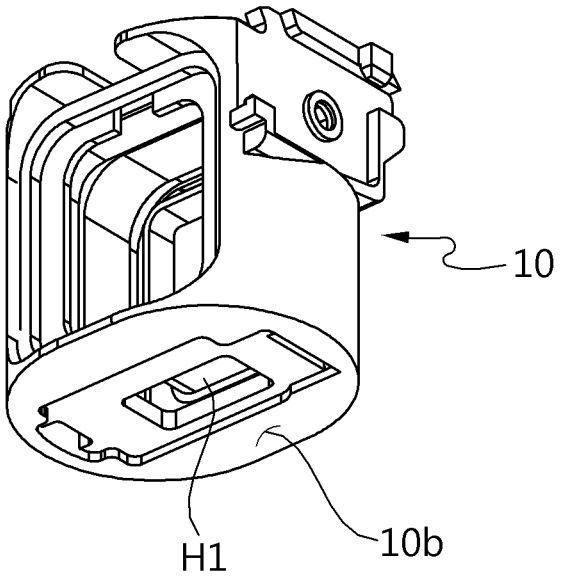
FIG. 6 is a bottom view of a frame.
Figure 7:
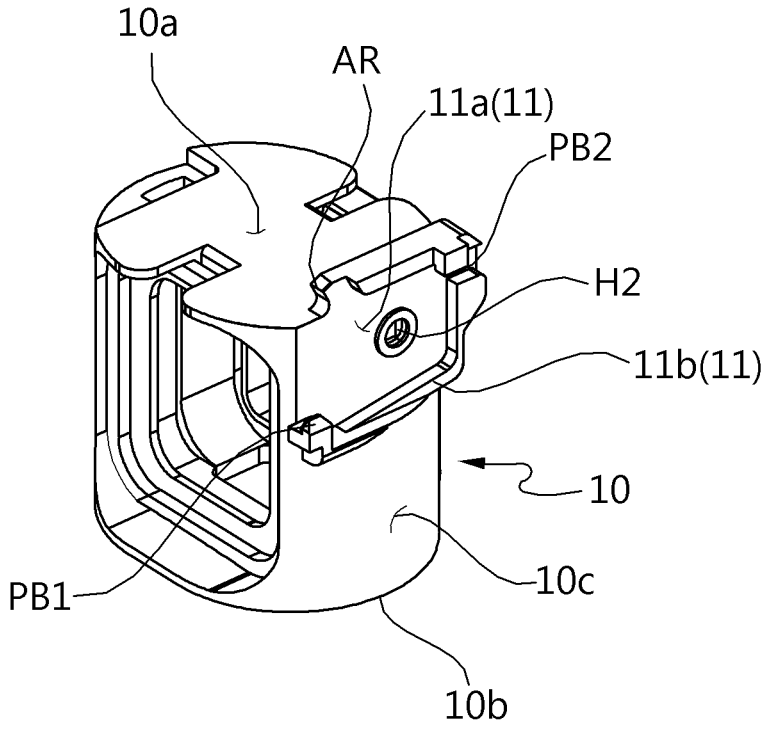
FIG. 7 is a perspective view of the frame.

FIG. 5 is a diagram illustrating the frame 10 and the microphone 90 of the speaker unit illustrated in FIG. 4, FIG. 6 is a bottom view of the frame 10, and FIG. 7 is a perspective view of the frame 10.

Referring to FIGS. 5 to 7, the frame 10 has an accommodating space inside. In addition, an outer surface of the frame 10 includes one surface 10*a*, the other surface 10*b*, and a lateral surface 10*c*. The one surface 10*a* may be a front surface of the frame 10, the other surface 10*b* may be a rear surface of the frame 10. The lateral surface may connect the one surface 10*a* and the other surface 10*b*. The hole H1 through which sound is emitted may be disposed on the one surface 10*a* of the frame 10.

The microphone 90 may be mounted on the outer surface of the frame 10. For example, the microphone 90 may be disposed on the lateral surface of the frame 10. The frame 10 may include a seating portion 11. The seating portion 11 may include a seating surface 11*a* and a guide 11*b*. The seating surface 11*a* is a surface in contact with the microphone 90.

An adhesive may be applied to or an adhesive tape may be disposed on the seating surface 11*a* to secure a coupling force between the seating surface 11*a* and the microphone 90.

The guide 11*b* is disposed along a periphery of the seating surface 11*a* to form a slot in which the microphone 90 is accommodated. The guide 11*b* may be disposed to protrude from the outer surface of the frame 10.

The seating surface 11*a* may be a portion of the lateral surface of the frame 10. The seating portion 11 may include a hole H2 disposed on the seating surface 11*a*. The inside and the outside of the frame 10 communicate with each other through the hole H2. The seating portion 11 may include a rib 11*c*. The rib 11*c* may be disposed along the circumference of the hole H2. The rib 11*c* may protrude from the seating surface 11*a* to align the position of the frame 10 with the microphone 90 and increase the coupling force between the microphone 90 and the frame 10. The guide 11*b* may form an inlet opening into which the microphone 90 is introduced.

The guide 11*b* may include protruding portions PB1 and PB2. The protruding portions PB1 and PB2 may protrude from the guide 11*b* and be disposed to overlap a portion of the microphone 90 disposed on the seating portion 11. The protruding portions PB1 and PB2 serve to fix the microphone 90 in the seating portion 11 so that it is not separated from the seating portion 11. In addition, a plurality of protruding portions PB1 and PB2 may be disposed. For example, the protruding portions PB1 and PB2 may include a first protrusion PB1 and a second protrusion PB2. The first protrusion PB1 may be disposed in the vicinity of the inlet opening of the seating portion 11. The second protrusion PB2 may be positioned inside the seating portion 11. The first protrusion PB1 may be disposed on one side of the hole H2 with respect to the front-to-rear direction and the second protrusion PB2 may be disposed on the other side of the hole H2.

The guide 11*b* may include a first area AR that protrudes from the one surface 10*a* of the frame 10 in the front-to-rear direction. The first area AR serves to expand the space of the seating portion 11 in the front-to-rear direction. The second protrusion PB2 may be disposed in the first area AR.

Figure 8:
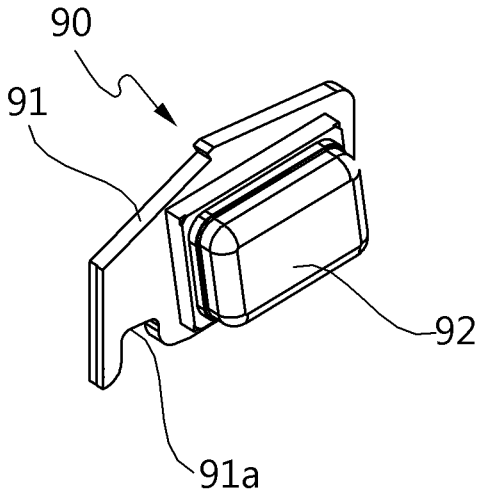
FIG. 8 is a perspective view of a surface of a microphone.
Figure 9:
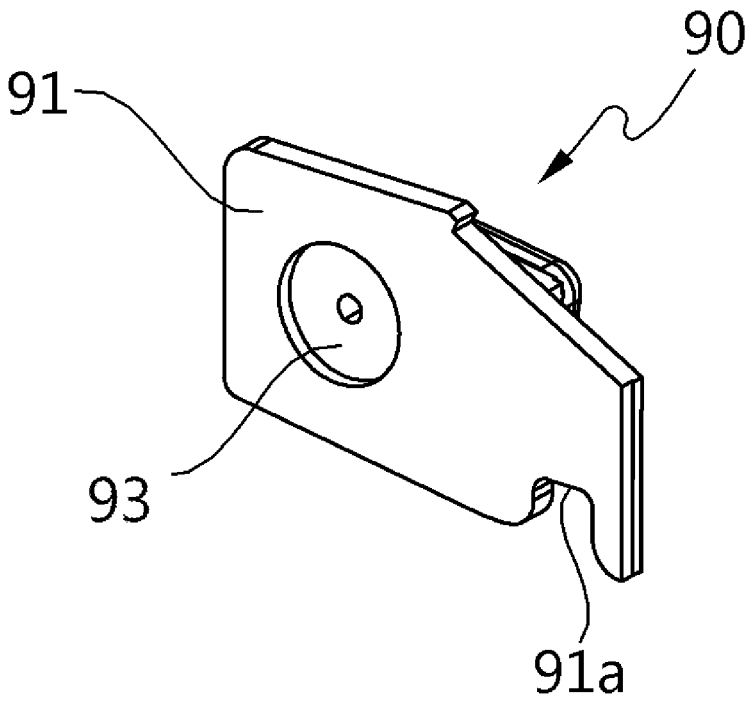
FIG. 9 is a perspective view of a rear surface of the microphone.

FIG. 8 is a perspective view of a surface of the microphone 90, and FIG. 9 is a perspective view of the rear surface of the microphone 90.

Referring to FIGS. 2, 8, and 9, the microphone 90 may include a base 91 and a microphone module 92 disposed on a surface of the base 91. The base 91 may include a first groove 91*a*. The first groove 91*a* is recessed from an edge of the base 91 and forms a hook-shaped locking structure in which a portion of the guide 11*b* is positioned. The first groove 91*a* serves to prevent the microphone 90 from being separated or lifted from the mounting portion and to increase the coupling between the microphone 90 and the frame 10.

The base 91 may include a second groove 93 recessed on a surface in contact with the seating surface 11*a*. When the base 91 is in contact with the seating surface 11*a*, the rib 11*c* is inserted into the second groove 93 to increase the coupling between the microphone 90 and the frame 10 and align the positions of the microphone module 92 and the hole H2 of the frame 10.

Figure 10:
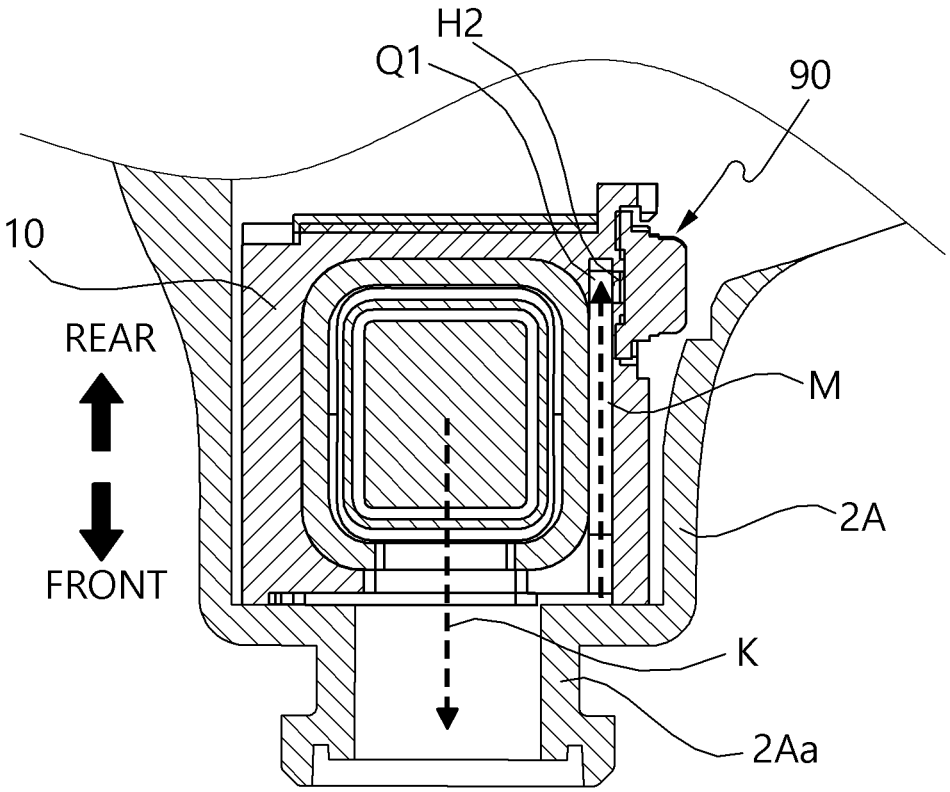
FIG. 10 is a side cross-sectional view of the speaker unit taken along line B-B of FIG. 2.

FIG. 10 is a side cross-sectional view of the speaker unit taken along line B-B of FIG. 2.

Referring to FIG. 10, the frame 10 may include a first passage Q1. The first passage Q1 communicates a nozzle 2Aa of a housing 2A with the hole H2 and serves to guide sound introduced into the nozzle 2Aa to the microphone 90. The first passage Q1 may be disposed on a lateral wall of the frame 10 to communicate with the hole H2 and the nozzle 2Aa. Sound introduced into the nozzle 2Aa of the housing 2A is introduced into the microphone 90 through the first passage Q1*a* and the hole H2. Thus, a direction M in which sound is transmitted to the microphone 90 through the first passage Q1 and a direction in which sound K is emitted from the first diaphragm 70 and the second diaphragm 80 may be opposite to each other.

Figure 11:
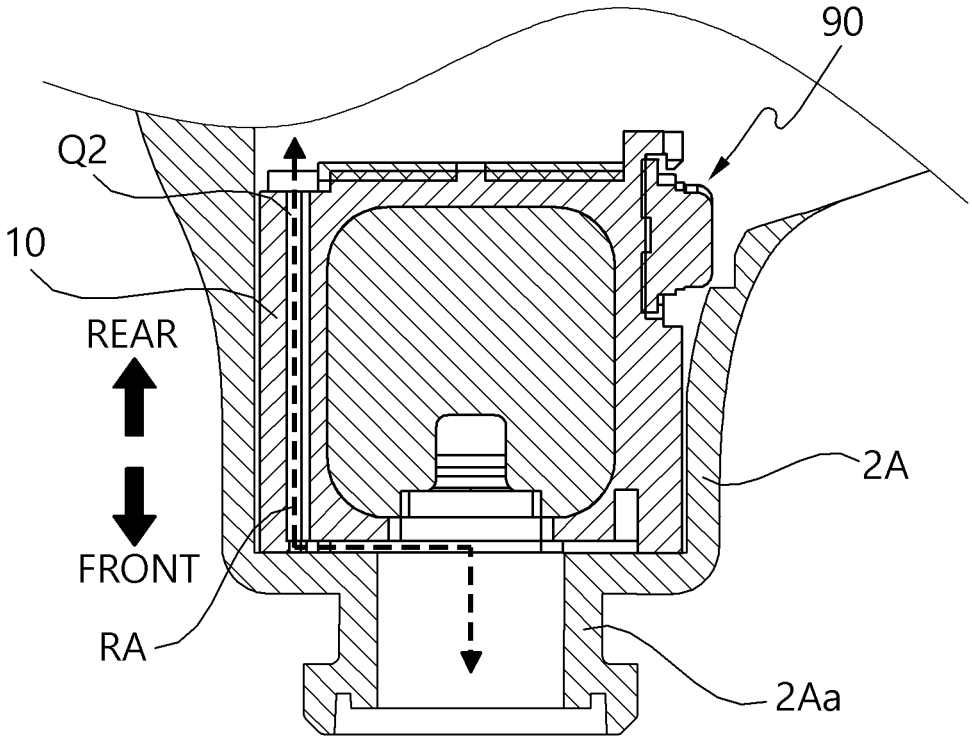
FIG. 11 is a side cross-sectional view of the speaker unit taken along line C-C of FIG. 2.

FIG. 11 is a side cross-sectional view of the speaker unit taken along line C-C of FIG. 2.

Referring to FIG. 11, the frame 10 may include a second passage Q2. The second passage Q2 may communicate a front space and a rear space of the speaker unit 1A to release the pressure of the user's ear. The second passage Q2 may be disposed on the lateral wall of the frame 10 to communicate the nozzle 2Aa of the housing 2A with the internal space of the housing 2A. The second passage Q2 may provide air pressure equalization as well as tune the ultra-low frequency sound.

Figure 12:
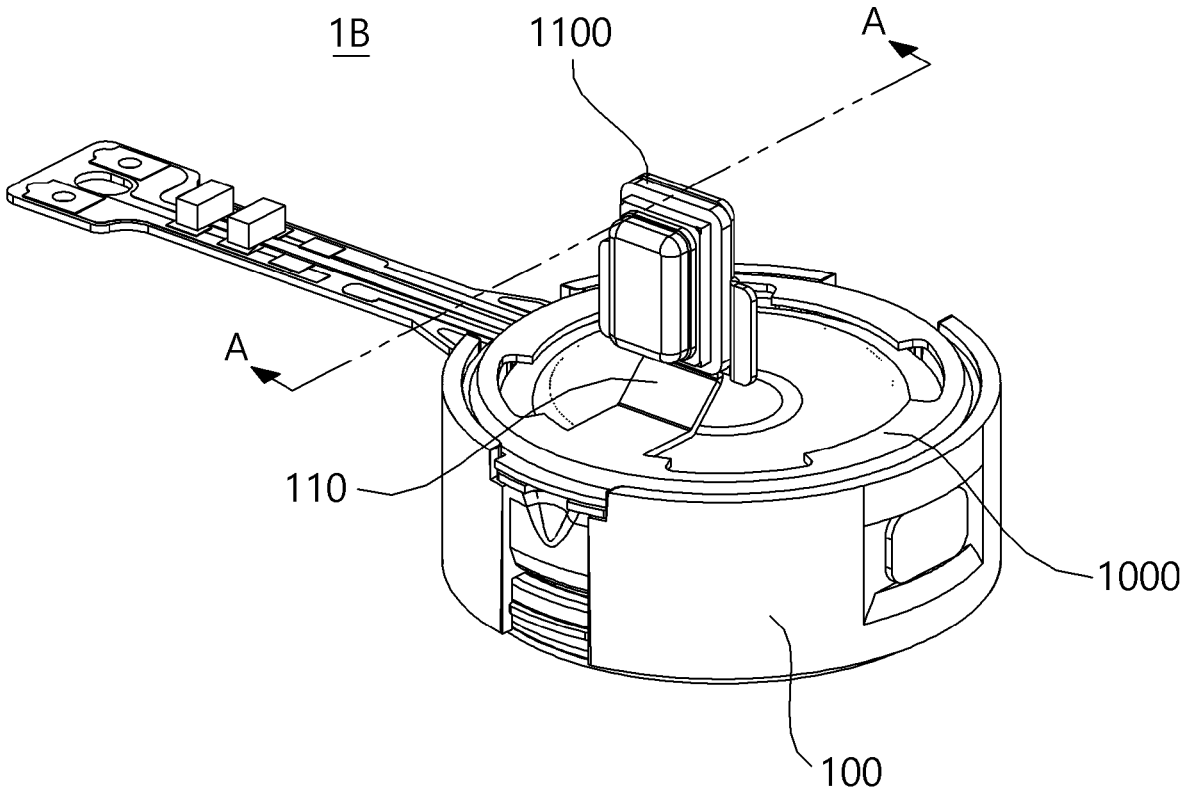
FIG. 12 is a diagram illustrating a speaker unit according to another embodiment.
Figure 13:
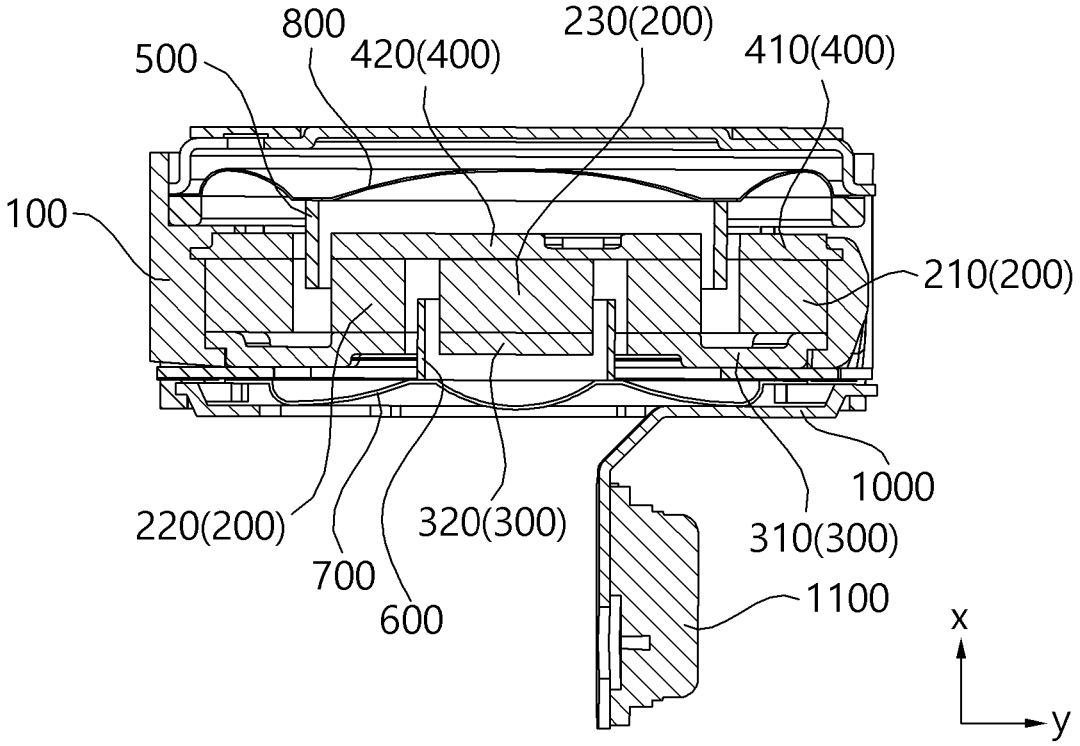
FIG. 13 is a side cross-sectional view of the speaker unit taken along line A-A of FIG. 12.
Figure 14:
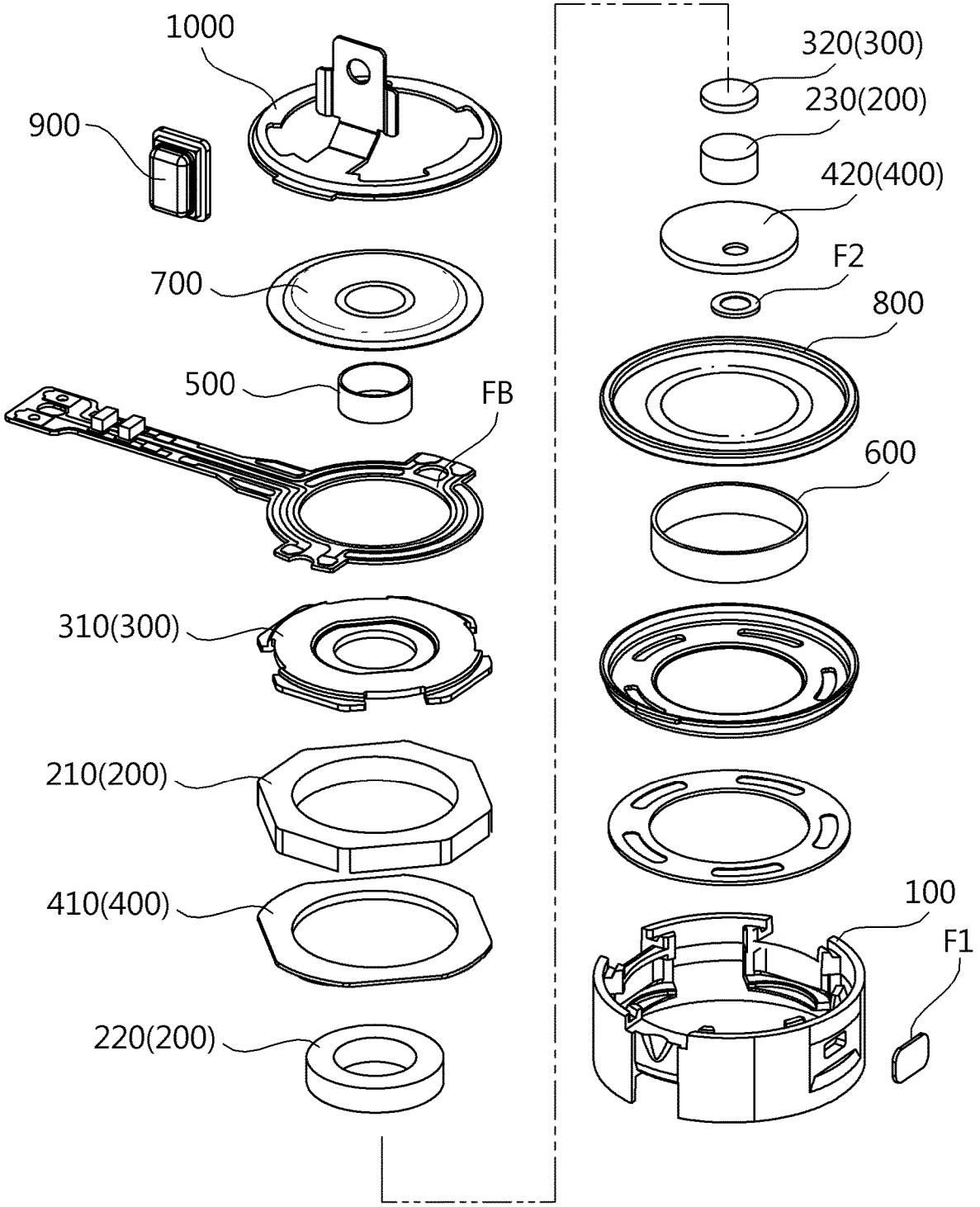
FIG. 14 is an exploded view of the speaker unit shown in FIG. 12.

FIG. 12 is a diagram illustrating a speaker unit according to another embodiment, FIG. 13 is a side cross-sectional view of the speaker unit taken along line A-A of FIG. 12, and FIG. 14 is an exploded view of the speaker unit shown in FIG. 12.

Hereinafter, in the drawings, the x-axis represents the front-to-rear direction of an earphone, and the y-axis represents the radial direction of the earphone. The terms "front" or "forward" refer to a direction in which sound is emitted through a first diaphragm 700 and a second diaphragm 800, and the terms "rear" or "rearward" refer to the direction opposite to the front or forward direction.

A speaker unit 1B according to an embodiment includes both configurations (two-way type) for reproducing sound in a low frequency range and sound in a high frequency range. In addition, the speaker unit 1B according to the embodiment includes a configuration for reproducing low-frequency sounds and a configuration for reproducing high-frequency sounds.

Figure 17:
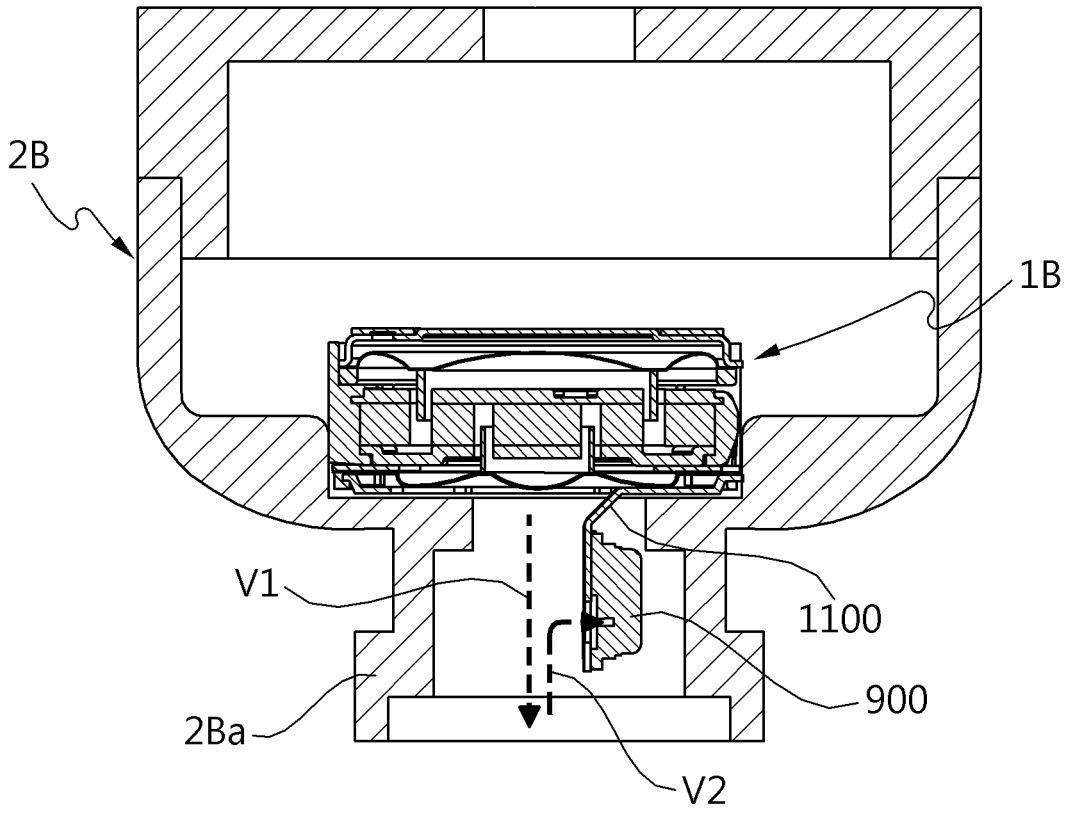
FIG. 17 is a side cross-sectional view of an earphone including a speaker unit according to an embodiment.

The speaker unit 1B according to the embodiment may be disposed in an internal space formed by a housing (2B in FIG. 17).

The speaker unit 1B according to the embodiment may include a frame 100, a magnet 200, a first plate 300, a second plate 400, a first coil 500, a second coil 600, a first diaphragm 700, a second diaphragm 800, a microphone 900, and a grill 1000. The speaker unit 1B according to the embodiment is characterized in that the microphone 900 is mounted on the grill 1000 without a separate bracket.

The frame 100 may be a cylindrical member.

The magnet 200 electromagnetically interacts with the first coil 500 and the second coil 600. The magnet 200 may include a first magnet 210, a second magnet 220, and a third magnet 230. The first magnet 210 may be disposed outside the second coil 600 and fixed to the frame 100. The third magnet 230 may be disposed inside the first coil 500. The second magnet 220 may be disposed between the first coil 500 and the second coil 600 in the radial direction y.

With respect to the radial direction y of the earphone, the third magnet 230 may be positioned innermost, the first magnet 210 may be positioned outermost, and the second magnet 220 may be disposed between the first magnet 210 and the third magnet 230.

The first magnet 210 and the second magnet 220 may be annular members. The third magnet 230 may be a cylindrical member.

The first magnet 210 and the second magnet 220 are used for reproducing low-frequency sounds, and the second magnet 220 and the third magnet 230 are used for reproducing high-frequency sounds.

The first plate 300 is in contact with one surface of the magnet 200 so that a magnetic field is created. The first plate 300 may include a first A plate 310 and a first B plate 320. The first A plate 310 may have a ring shape. The first A plate 310 is in contact with one surface of the first magnet 210 and one surface of the second magnet 220. The first B plate 320 may have a disk shape. The first B plate 320 is in contact with one surface of the second magnet 220.

The second plate 400 is in contact with the other surface of the magnet 200 so that a magnetic field is created. The second plate 400 may include a second A plate 410 and a second B plate 420. The second A plate 410 may be an annular plate. The second A plate 410 is in contact with the other surface of the first magnet 210. The second B plate 420 may have a disk shape. The second B plate 420 is in contact with one surface of the second magnet 220 and one surface of the third magnet 230.

The first coil 500 is fixed to the first diaphragm 700. When the first coil 500 moves, the first diaphragm 700 also moves in conjunction with this movement. The first coil 500 may be disposed between the second magnet 220 and the third magnet 230 in the radial direction y. Also, the first coil 500 may be disposed between the first A plate 310 and the first B plate 320 in the radial direction y. Accordingly, the first coil 500 is disposed to partly overlap the second magnet 220 and the third magnet 230 in the radial direction y. In addition, the first coil 500 is disposed to partly overlap the first plate 300 in the radial direction y. The first coil 500 may be used for reproducing high-frequency sound.

The second coil 600 is fixed to the second diaphragm 800. When the second coil 600 moves, the second diaphragm 800 also moves in conjunction with this movement. The second coil 600 may be disposed between the first magnet 210 and the second magnet 220 in the radial direction y. Also, the second coil 600 may be disposed between the second A plate 410 and the second B plate 420 in the radial direction y. Accordingly, the second coil 600 is disposed to partly overlap the first magnet 210 and the second magnet 220 in the radial direction y. In addition, the second coil 600 is disposed to partly overlap the second plate 400 in the radial direction y. The first coil 500 may be used for reproducing high-frequency sound.

The first diaphragm 700 may be fixed to a flexible printed circuit board (FPCB) FB. The first diaphragm 700 may be used for reproducing high-frequency sound.

The second diaphragm 800 may be fixed to a fixing ring 810. The fixing ring 810 may be fixed to a grill 1000 and the frame 100. The second diaphragm 800 may be used for reproducing low-frequency sound.

The microphone 900 may be directly coupled to the frame 1000 without an additional bracket. The grill 1000 is provided with a structure for mounting the microphone.

The grill 1000 is disposed on one side of the first diaphragm 700 with respect to the front-to-rear direction x. In addition, the grill 1000 may be fixed to the frame 100.

The FPCB FB supplies an electrical signal to the first coil 500 and the second coil 600. The FPCB FB may be made of a soft material.

A first tuning portion F1 may be disposed on the frame 100. A second tuning portion F2 may be disposed on the first B plate 320. The first tuning portion F1 and the second tuning portion F2 are provided to change the tone or acoustic characteristics, and may be made of a mesh material including polyester, nylon, non-woven fabric, membrane filter, or the like.

A magnetic field moves to a space between the first plate 300 and the second plate 400. When the first coil 500 and the second coil 600 are magnetized by an electric current applied thereto, the first coil 500 and the second coil 600 are moved according to magnetic polarities of the first coil 500 and the second coil 600.

That is, when the magnetic polarity of the first coil 500 is the same as that of the first plate 300, the first coil 500 moves by being pushed away from the first plate 300. When the magnetic polarity of the second coil 600 is the same as that of the second plate 400, the second coil 600 is moved by being pushed away from the second plate 400. On the other hand, when the magnetic polarity of the first coil 500 is opposite to that of the first plate 300, the first coil 500 is attracted and moves toward the first plate 300. In addition, when the magnetic polarity of the second coil 600 is opposite to that of the second plate 400, the second coil 600 is attracted and moves toward the second plate 400. In this way, the first and second diaphragms 700 and 800 move and vibrate the air to produce sound.

Figure 15:
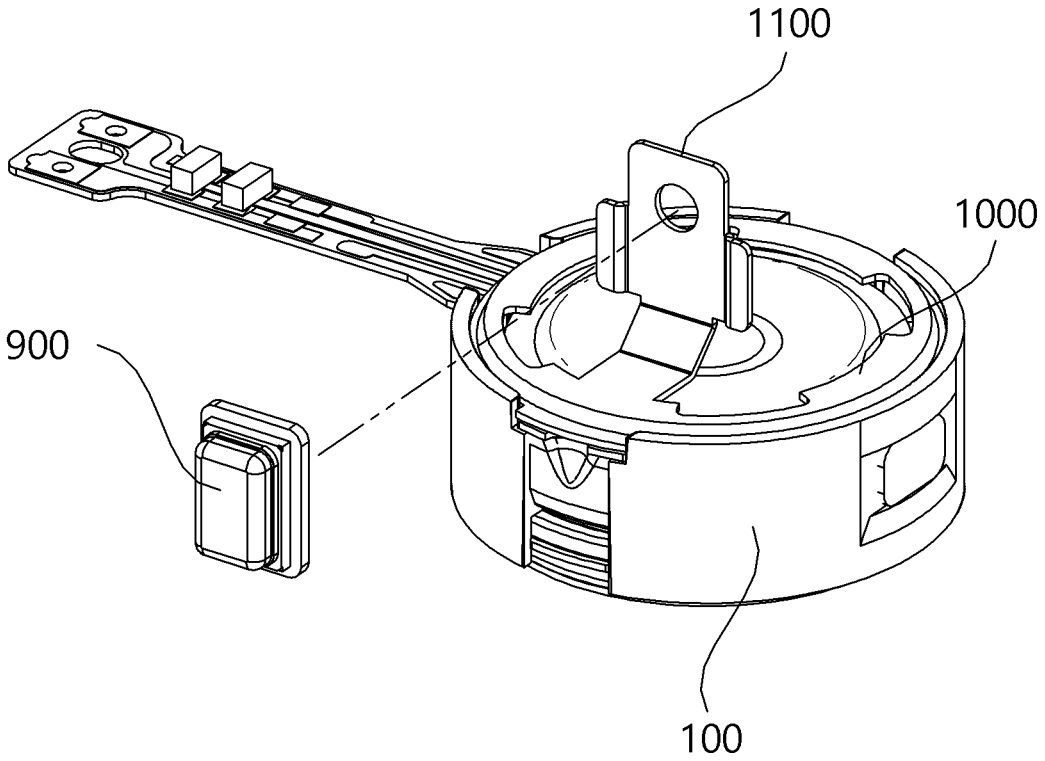
FIG. 15 is a diagram illustrating a microphone mounted on a grill.
Figure 16:
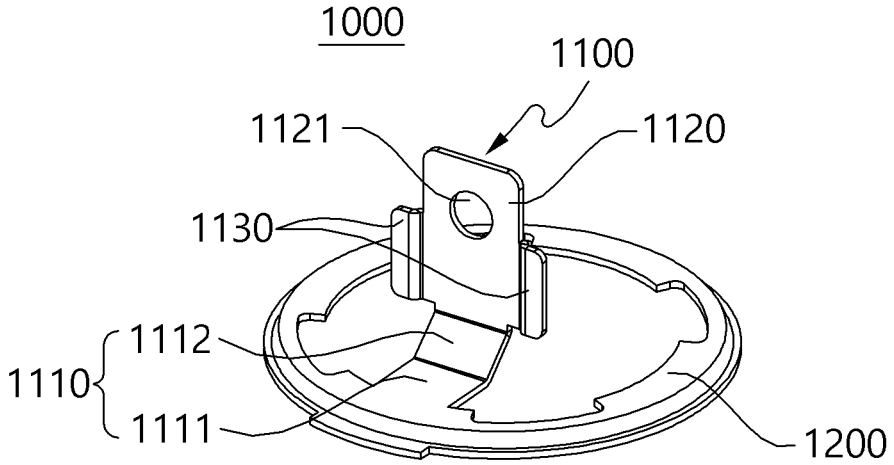
FIG. 16 is a diagram illustrating a grill including a seating portion.

FIG. 15 is a diagram illustrating the microphone 900 mounted on the grill 1000, and FIG. 16 is a diagram illustrating the grill 1000 including a seating portion 1110.

Referring to FIGS. 15 and 16, the microphone 900 is directly fixed to the grill 1000 without a separate bracket. The grill 1000 may include a seating portion 1100 and a body 1200 in an annular shape. The body 1200 is fixed to the frame 100.

The seating portion 1100 may include a first part 1110 extending from an inner circumferential surface of the body 1200 and a second part 1120 to which the microphone 900 is mounted. The second part 1120 extends from the first part 1110.

The first part 1110 may include a first-1 part 1111 and a first-2 part 1112. The first-1 part 1111 extends inward from an inner side of the body 1200. The first-2 part 1112 extends forward from the first-1 part 1111 and is connected to the second part 1120. In this case, the first-2 part 1112 may be bent upward and extended from the first-1 part 1111. In addition, when the body 1200 is in a lying (horizontal) state, the second part 1120 may be disposed in a standing (vertical) state.

The seating portion 1100 may include a guide 1130. The guide 1130 may be disposed on each side of the second part 1120. The guide 1121 may be formed to be stepped from the second part 1120 so as to be in contact with each side of the microphone 900.

The seating portion 1100 is disposed to overlap the first diaphragm 700. Accordingly, the microphone 900 fixed to the seating portion 1100 may also be disposed to overlap the first diaphragm 700.

The speaker unit 1B according to the embodiment may fix the microphone 900 without a separate bracket.

FIG. 17 is a side cross-sectional view of an earphone including a speaker unit 1B according to an embodiment.

Referring to FIG. 17, a microphone 900 is mounted on a seating portion 1100, and is positioned inside a nozzle 2Ba of a housing 2B. Sound V1 emitted from a speaker unit 1B is emitted through a nozzle 2Ba, and sound V2 introduced through the nozzle 2Ba is directly introduced into the microphone 900. Therefore, sound may be easily flow into the microphone 900.

According to the embodiment, a bracket for mounting a microphone is removed, and the microphone is directly mounted on the frame, so that sufficient design space for the speaker unit can be secured.

According to the embodiment, a first passage and a hole that communicate with a seating portion of the speaker unit are disposed on the frame, thereby allowing a signal to smoothly flow into the microphone.

According to the embodiment, a second passage for releasing the pressure of the user's ear by communicating the front space and the rear space of the speaker unit is disposed on the frame, so that the sufficient design space for the speaker unit can be secured.

According to the embodiment, a bracket for mounting the microphone is removed, and the microphone is directly mounted on the grill, so that the sufficient design space for the speaker unit can be secured.

According to the embodiment, the seating portion of the grill is placed in the nozzle of the housing so that sound can be easily introduced into the microphone.

Although the preferred embodiments of the speaker unit have been disclosed for illustrative purposes, those skilled in the art will appreciate that various modifications, additions and substitutions are possible, without departing from the scope and spirit of the invention as disclosed in the accompanying claims. Therefore, it should be noted that such modifications or changes belong to the claims of the present invention.

What is claimed is:

1. A speaker unit comprising:

a frame;

a yoke elongated on the frame along a front-to-rear direction;

a first magnet disposed on one side of the yoke;

a first plate disposed on one side of the first magnet;

a first diaphragm disposed on one side of the first plate;

a first coil fixed to the first diaphragm;

a second magnet disposed on the other side of the yoke;

a second plate disposed on the other side of the second magnet;

a second diaphragm disposed on the other side of the second plate;

a substrate disposed on the frame;

a microphone electrically connected to the substrate; and a second coil fixed to the second diaphragm, wherein the first magnet and the second magnet are both in contact with the yoke, the frame includes a seating portion, and the microphone is disposed in the seating portion.

2. The speaker unit of claim 1, wherein the frame has one surface on which a sound emission hole is disposed, the other surface opposite to the one surface, and a lateral surface connecting the one surface to the other surface, and the seating portion is disposed on the lateral surface.

3. The speaker unit of claim 1, wherein the frame may comprises a seating surface in contact with the microphone, and a guide disposed along a periphery of the seating surface to form a slot in which the microphone is accommodated.

4. The speaker unit of claim 3, wherein the frame comprises a plurality of protruding portions protruding from the guide and disposed to overlap a portion of the microphone.

5. The speaker unit of claim 4, wherein the microphone comprises a base and a microphone module disposed on the base, the base comprises a groove, and a part of the guide is disposed in the groove.

6. The speaker unit of claim 5, wherein the frame comprises a hole disposed on the seating surface and a first passage connected from the other surface of the frame to the hole and the hole communicates with the first passage.

7. The speaker unit of claim 6, wherein the frame comprises a second passage passing through one side and the other side of the frame.

8. The speaker unit of claim 7, wherein a direction in which sound is transmitted to the microphone through the first passage and a direction in which sound is emitted from the first diaphragm and the second diaphragm are opposite to each other.

9. The speaker unit of claim 6, wherein the frame comprises a rib protruding from the seating surface and disposed along a circumference of the hole and the base comprises a first surface in contact with the seating surface, and a first groove recessed on the first surface and allowing the rib to be positioned therein.

10. The speaker unit of claim 5, wherein the guide comprises a first area protruding from one surface of the frame and some of the plurality of protruding portions are disposed in the first area.

11. A speaker unit comprising:

a frame;

a magnet;

a plate fixed to the frame and in contact with the magnet;

a diaphragm;

a coil disposed to overlap the magnet and the plate in a radial direction;

a flexible printed circuit board (FPCB);

a microphone connected to the FPCB; and a grill disposed on the frame, wherein the grill includes a seating portion and the microphone is disposed in the seating portion, and wherein the grill comprises an annular-shaped body fixed to the frame and the seating portion comprises a first part extending from an inner circumferential surface of the body and a second part extending from the first part to which the microphone is mounted.

12. The speaker unit of claim 11, wherein the first part comprises a first-1 part and a first-2 part, the first-1 part extends inward from the inner circumferential surface of the body, and the first-2 part extends forward from the first-1 part and is connected to the second part.

13. The speaker unit of claim 12, wherein the seating portion comprises a guide extending from each side of the second part and disposed to be stepped from the second part so as to be in contact with each side of the microphone.

14. The speaker unit of claim 11, wherein the seating portion is disposed to overlap the diaphragm in a front-to-rear direction.

15. The speaker unit of claim 11, wherein the microphone is disposed to overlap the diaphragm in a front-to-rear direction.

* * * * *